United States Patent [19]

Patterson et al.

[11] Patent Number: 4,833,834

[45] Date of Patent: May 30, 1989

[54] CAMSHAFT BELT GRINDER

[75] Inventors: Henry B. Patterson, Perkinsville, Vt.; Eberhard E. Wasserbaech, Utica; Jae M. Lee, Madison Heights, both of Mich.

[73] Assignee: General Motors Corporation, Detroit, Mich.

[21] Appl. No.: 115,025

[22] Filed: Oct. 30, 1987

[51] Int. Cl.[4] ..... B24B 21/00; B24B 7/00

[52] U.S. Cl. ..... 51/147; 51/101 R

[58] Field of Search ..... 51/101 R, 145 R, 147

[56] References Cited

U.S. PATENT DOCUMENTS

| | | |
|---|---|---|
| 1,660,291 | 2/1928 | Birkigt . |
| 1,813,503 | 7/1931 | Merryweather . |
| 1,843,301 | 2/1932 | Player et al . |
| 2,098,438 | 11/1937 | Stubbs . |
| 2,195,054 | 3/1940 | Wallace et al. . |
| 2,553,831 | 5/1951 | Musyl . |
| 2,810,480 | 10/1957 | Carroll . |
| 2,823,494 | 2/1958 | Board, Jr. . |
| 3,136,097 | 6/1964 | Liard . |
| 3,760,537 | 9/1973 | Bovati . |
| 4,091,573 | 5/1978 | Schmidt . |
| 4,175,358 | 11/1979 | Bischeri . |
| 4,292,767 | 10/1981 | Fatula . |
| 4,309,848 | 1/1982 | Arrigoni . |
| 4,382,727 | 5/1983 | Schmidt . |
| 4,407,096 | 10/1983 | Steinback . |

FOREIGN PATENT DOCUMENTS

| | | |
|---|---|---|
| 2073069 | 10/1981 | United Kingdom . |

*Primary Examiner*—John K. Corbin
*Assistant Examiner*—J. Ryan
*Attorney, Agent, or Firm*—Robert J. Outland

[57] ABSTRACT

Various embodiments of multiple belt camshaft grinding machines each have grinding belt drive, contouring and support members carried on a feed table for separate control of cam contouring and grinding feed rate while the camshaft workpiece is carried on a fixed axis by a table providing axial motion for belt wear balancing oscillation and, optionally, camshaft indexing. Curved shoe or wheel contouring members allow reverse curve cam grinding. Special shoe materials and belt-shoe lubrication may be provided to reduce shoe wear. Other features are also disclosed.

19 Claims, 6 Drawing Sheets

CAMSHAFT BELT GRINDER

TECHNICAL FIELD

This invention relates to camshaft belt grinders and, more particularly, to multiple belt grinding machines for grinding the lobes of camshafts for engines and the like.

BACKGROUND

It is known in the art relating to camshaft manufacturing to use cam grinding and lapping machines with traditional circular grinding and lapping wheels as shown, for example in U.S. Pat. Nos. 1,660,291 Birkigt, 1,813,503 Merryweather, 1,843,301 Player et al, 2,098,438 Stubbs, 2,195,054 Wallace et al and 2,553,831 Musyl. Such grinding machines commonly require relatively expensive grinding wheels which must be dressed often.

A camshaft grinder having multiple belts which are individually movable for simultaneously grinding the profiles of a plurality of cams of an engine camshaft or the like can make use of potentially lower cost long life abrasive belts which do not require dressing and can be easily replaced. Such a machine is shown in U.S. Pat. No. 4,175,358 wherein the grinding of individual cams is performed by straight sections of separate belts tautly drawn between idler rollers of a grinding head. Cam profiling is accomplished by a roller type cam follower mechanism while the grinding stroke is provided by infeed of a separate camshaft supporting table. This arrangement limits the ability to form cam profiles to those capable of being formed by a flat grinding surface. It also introduces inaccuracies by the use of a curved roller follower with the flat grinding surface. The camshaft table feed yields dual moving assemblies and results in the lack of a fixed center for the camshaft workpiece.

Belt grinders are also known for use with workpieces other than camshafts wherein the belts are forced into grinding engagement by curved shoes as in U.S. Pat. Nos. 2,823,494 Board, Jr. et al and 3,136,097 Laird or by wheels or drums as in U.S. Pat. Nos. 2,810,480 Carroll, 3,760,537 Bovati, 4,091,573 Schmidt, 4,292,767 Fatula, 4,382,727 Schmidt, 4,309,848 Arrigoni and 4,407,096 Steinback.

SUMMARY OF THE INVENTION

The present invention provides related arrangements of camshaft belt grinders having several significant features of novel design.

In general, the invention involves multiple belt grinders having grinding belt drive, contouring and support means carried on a feed table for separate control of cam contouring and grinding feed rate. The camshaft workpiece is carried for rotation on a fixed axis by a table that may provide axial motion for indexing or belt wear balancing oscillation.

In particular embodiments, machines according to the invention may include wheels or curved shoes for contacting the belts and applying grinding pressure. The shoes may be made with long wearing hard surfaced materials and may include special wear inserts. Cooling and lubricating fluid may be sprayed not only on the grinding face of the belts to carry away heat from the grinding process but also between the shoes and the backs of the belts to lubricate and cool the sliding action of the belts on the shoes.

Alternative contouring means may include cam followers using a master cam or a preferred numerically controlled actuator arrangement using motor driven ball screws or equivalent means. In multi-belt applications involving close cam spacing, the belt engaging shoes or wheels may be closely spaced in a common plane while their associated actuators are offset in one or more planes and staggered vertically and horizontally to provide room for their mounting.

Additionally, the belt support units or contouring heads of a grinding machine may be mounted for relative lateral adjustment of one or more of the grinding and contouring mechanisms to provide variable belt spacing that allows for use of the machine with various camshafts having different axial spacing of the cams.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
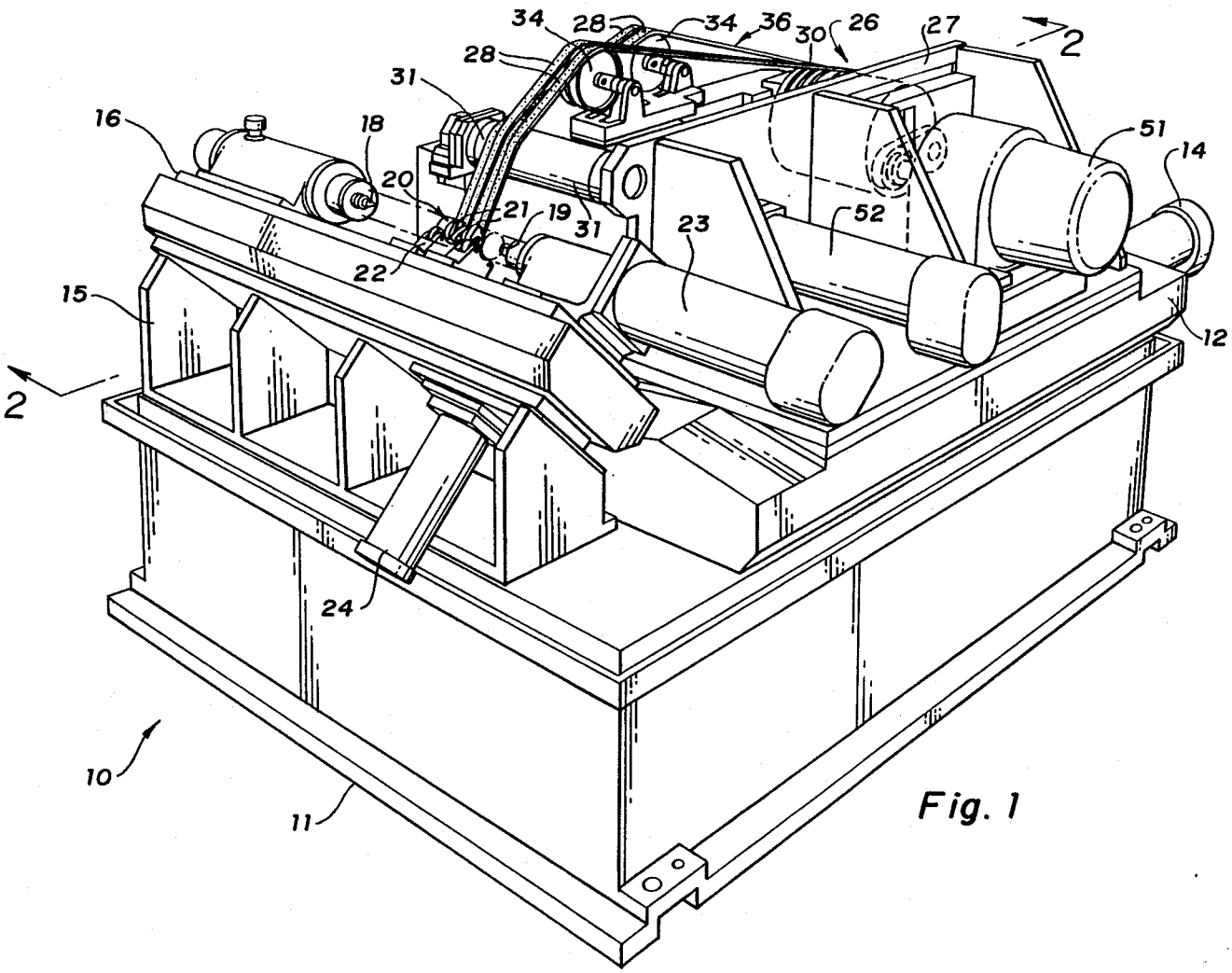
FIG. 1 is a pictorial view of a representative four belt camshaft grinding machine formed according to the invention.

Referring now to the drawings in detail, numeral 10 generally indicates a camshaft belt grinder formed in accordance with the invention. Grinder 10 includes base 11 on which is supported a feed table 12 that is slidably movable on ways, not shown, by a feed screw or other suitable means driven by a feed motor 14. The motion of the table 12 is longitudinal in forward and rearward directions to provide the grinding feed needed in operations performed on the grinder.

Also mounted on the base 11 forward of the table 12 is a workpiece support 15 mounting a laterally movable worktable 16 carrying centers 18, 19 for mounting a camshaft workpiece 20 having a plurality of cams 21 arranged, for example, in groups of four closely spaced cams each. A grinding steady rest 22 may also be provided. A cam drive motor 23 extends laterally from the live center 19 for rotatably driving the workpiece 20. A camshaft oscillating motor 24 is carried on the workpiece support 15 for driving the table 16 and camshaft 20 in a laterally oscillating motion during cam grinding.

Figure 2:
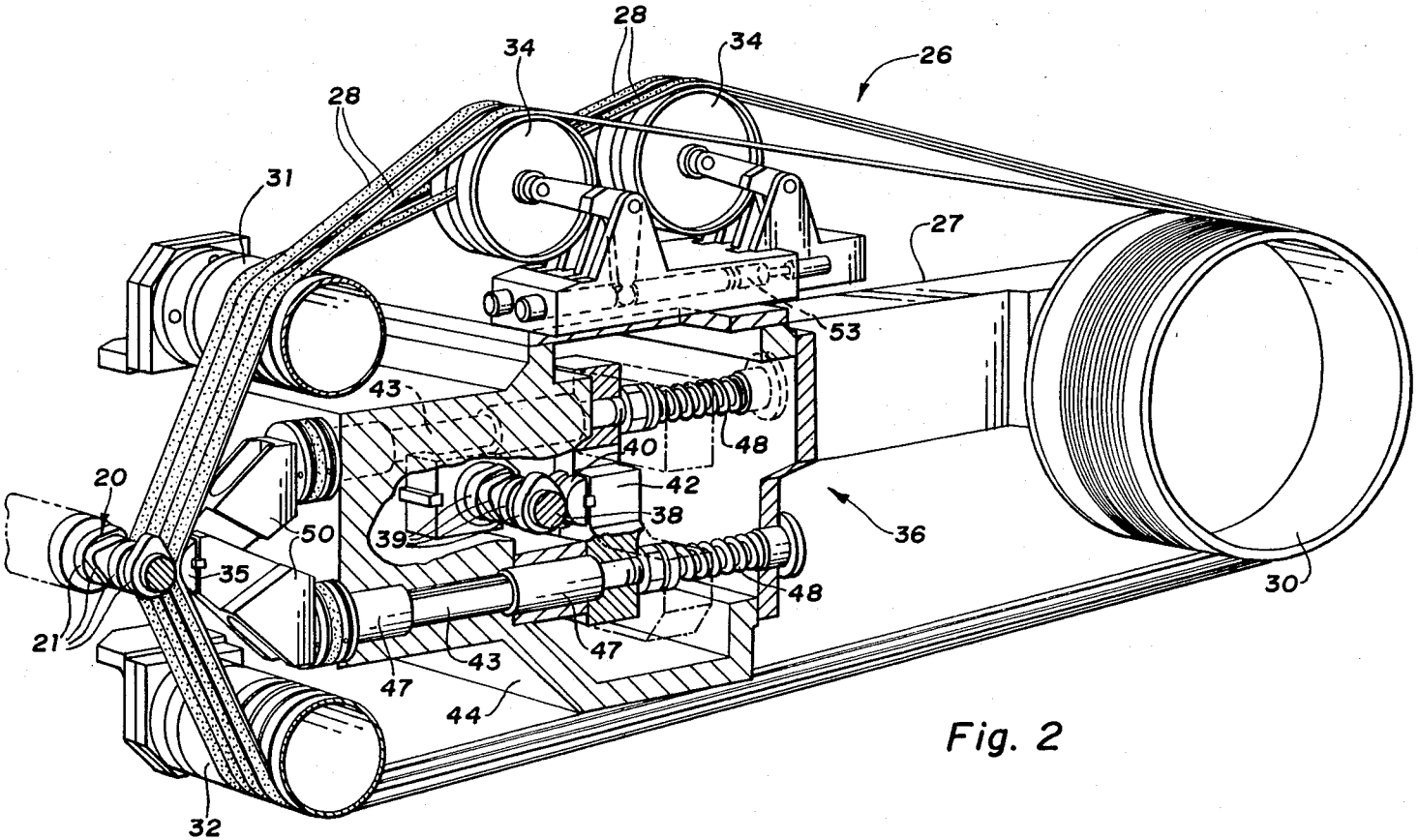
FIG. 2 is a pictorial cross-sectional view from the plane generally indicated by the line 2—2 of FIG. 1 and showing details of the master cam actuated contouring mechanism.

On the feed table 12, there is carried a contouring head assembly generally indicated by numeral 26 and portions of which are best shown in FIG. 2. Assembly 26 in oludes a frame 27 which supports four grinding belts 28 driven by a main drive pulley 30, guided by upper and lower guide pulleys 31, 32 and tensioned by individual tensioning pulleys 34.

The belts 28 are also contacted by individual contouring shoes 35 of a contouring drive assembly generally indicated by numeral 36. This assembly further includes a master camshaft 38 with a plurality of cams 39 shaped in the form desired for the workpiece cams, a follower shoe 40 for each cam 39, a carrier block 42 carrying each follower shoe, and a pushrod 43 mounting each carrier block. The pushrods are reciprocably carried, in a body 44 fixed to the feed table, by linear ball bearing sleeves 47 which prevent rotation of the pushrods and the blocks 42 in body 44. A spring 48 acts against each pushrod 43 to urge its follower shoe 40 against its respective master cam 39.

The front end of each pushrod carries an offset shoe carrier 50 that connects its pushrod with a respective one of the contouring shoes 35 to urge the shoe 35 against an associated one of the grinding belts 28 for grinding the associated cam surfaces of a camshaft workpiece. The shoe carriers 50 are offset to permit the close spacing of the cams 21 which requires the four grinding belts to be similarly closely spaced. The contouring push rods 43 are staggered above and below, as well as beside, the positions of their 5 contouring shoes 35 in order to accommodate the wider spacing required for the contouring mechanism.

On the feed table, a main drive motor 51 is mounted and connected for driving the main drive pulley 30. A master cam drive motor 52 is also mounted thereon and connected for rotatably driving the master camshaft 38. Motor 52 is controlled to operate in synchronism with the cam drive motor 23 so that the master camshaft 38 and the workpiece camshaft 20 are driven at the same phase angles and rotational speeds. On the contouring head assembly 26, the tensioning pulleys 34 are urged against the grinding belts by any suitable devices, such as air pressure actuated pistons 53.

In operation, the main drive motor 51 rotates the main drive pulley 30, driving the grinding belts over the tensioning pulleys 34, guide pulleys 31, 32 and contouring shoes 35. The shoes 35 are formed with a face curvature preferably identical to that of the follower shoes 40 and selected to provide accurate cam grinding with a predetermined amount of reverse cam curvature if desired. The guide pulleys are placed to maintain the desired amount of belt wrap about the guide shoes, limited to minimize friction and wear.

Concurrently, the workpiece cam drive motor 23 and the master cam drive motor 52 operate to drive the camshaft workpiece 20 and the master camshaft 38 in synchronous rotation about their respective axes. The follower shoes 40 follow the profiles of their respective master cams 39 and drive their respective pushrods 43 to reciprocate the associated contouring shoes 35 so as to replicate the shapes of the master cams on the cams 21 of the workpiece 20.

From an initial position spaced from the workpiece, the grinding belts are advanced to the final cleanup grinding position by forward feed motion of the feed table 12 driven by the feed motor 14 through a drive screw or other suitable feed mechanism, not shown. During the grinding process, the work table is preferably oscillated laterally a small amount to move the cams 21 being ground back and forth over the complete faces of the slightly wider grinding belts. This provides even belt wear and a more even finish on the completed cams 21.

NUMERICAL CONTROL

Figure 3:
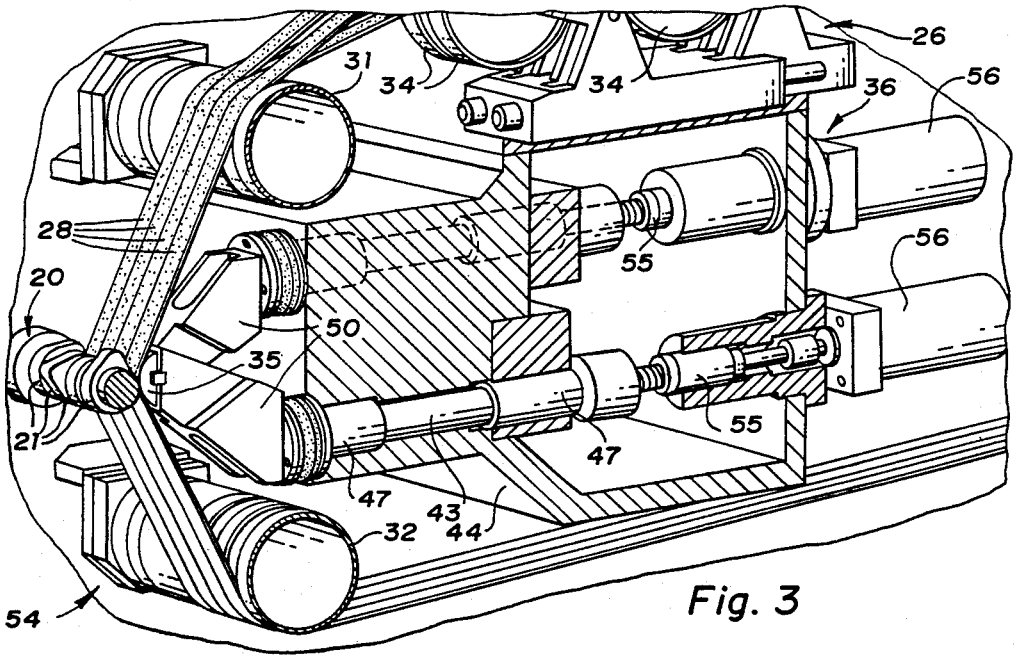
FIG. 3 is a fragmentary pictorial view similar to FIG. 2 but showing an alternative numerically controlled ball screw actuated contouring arrangement.

Referring now to FIG. 3, there is shown an alternative embodiment of grinder 54 similar to that of FIGS. 1 and 2 but using numerically controlled contouring devices. For convenience, like numerals are used for like parts.

In the FIG. 3 embodiment, the grinding belts 28 and the workpiece camshaft 20 are driven in the manner previously described. However, the contouring shoes 35 and their associated pushrods 43 are driven by directly connected ballscrews 55 actuated by numerically controlled individual contouring motors 56. The pushrods 43 and ballscrews 55 are staggered as in the earlier embodiment to provide for the close belt and cam spacing.

The operation is similar to that of the FIGS. 1 and 2 embodiment except that the contouring of the workpiece cams 21 is accomplished by numerically controlled actuation of the motor 56 in timed phase relation with the rotation of the workpiece camshaft 20 to reciprocate the shoes 35 so as to form the desired cam profiles.

ADJUSTABLE SPACING

Figure 4:
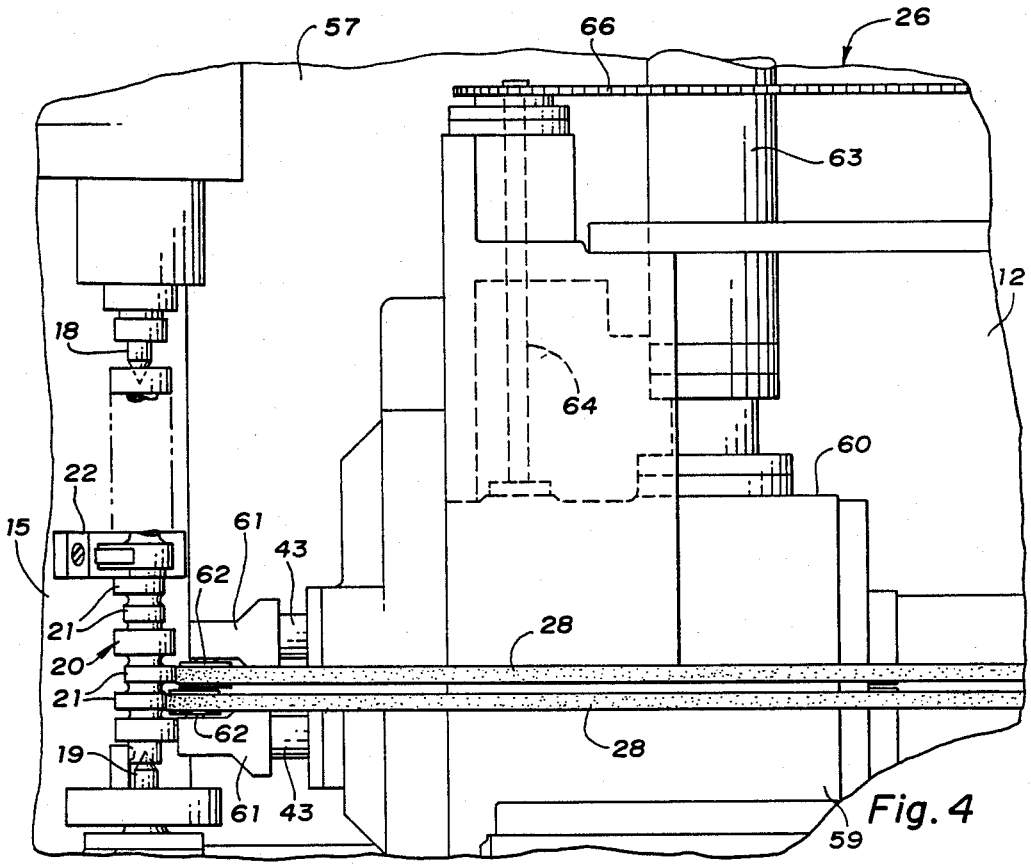
FIG. 4 is a fragmentary top view of a similar two belt embodiment having adjustable belt spacing with potentially closely spaced belts and staggered actuators.
Figure 5:
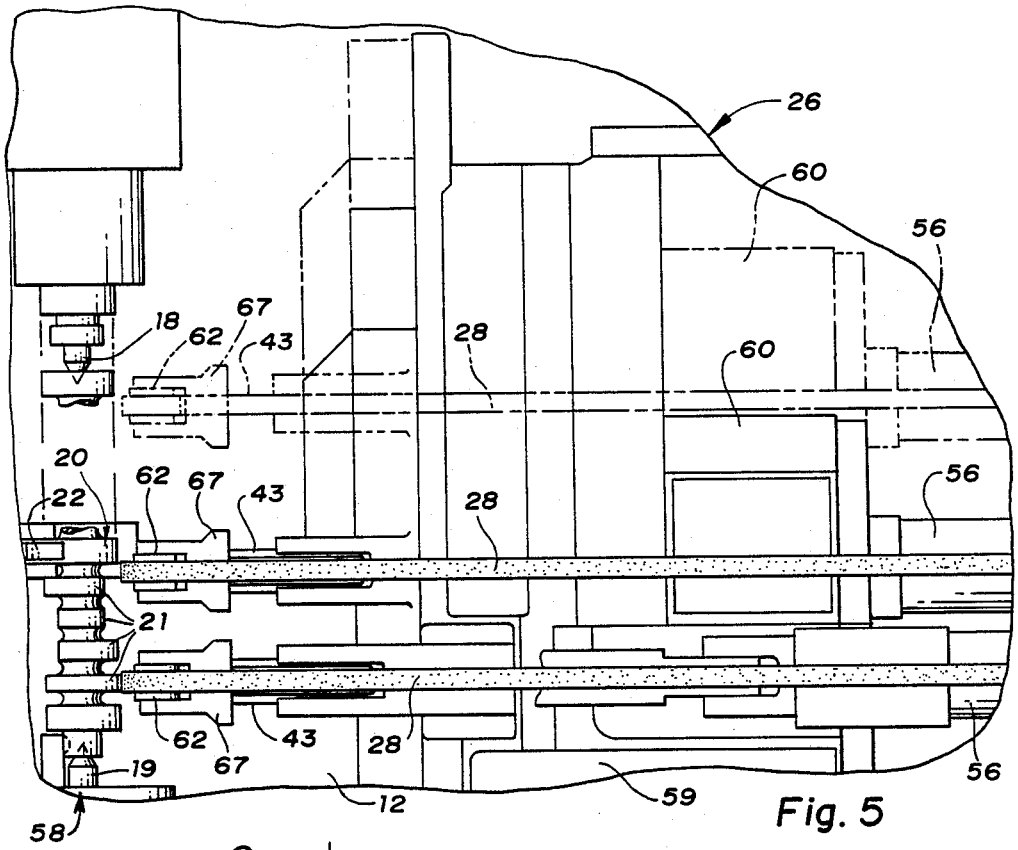
FIG. 5 is a frammentary top view of an alternative two belt embodiment.
Figure 6:
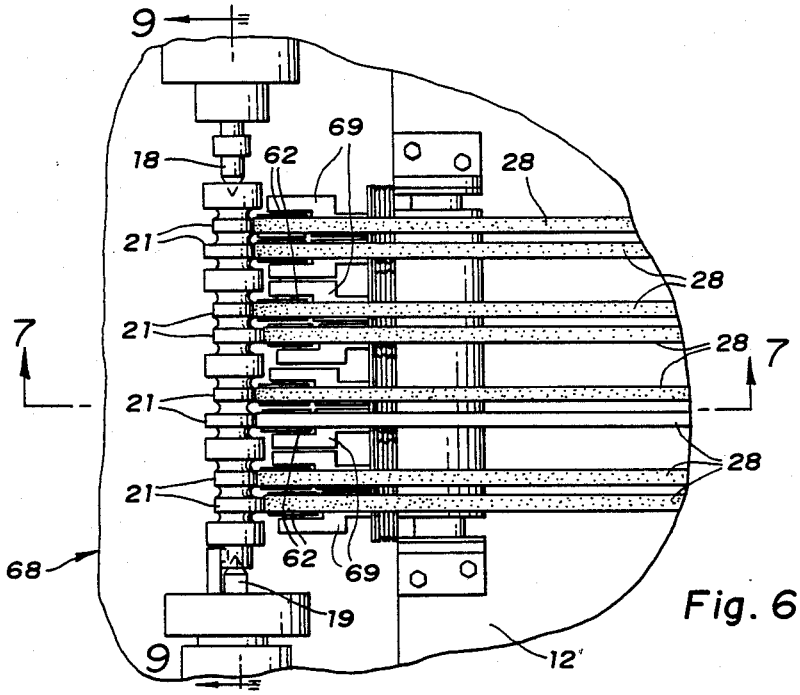
FIG. 6 is a fragmentary top view of an alternative eight belt embodiment having fixed spacing and staggered actuators for grinding simultaneously all the cams of a single camshaft.
Figure 7:
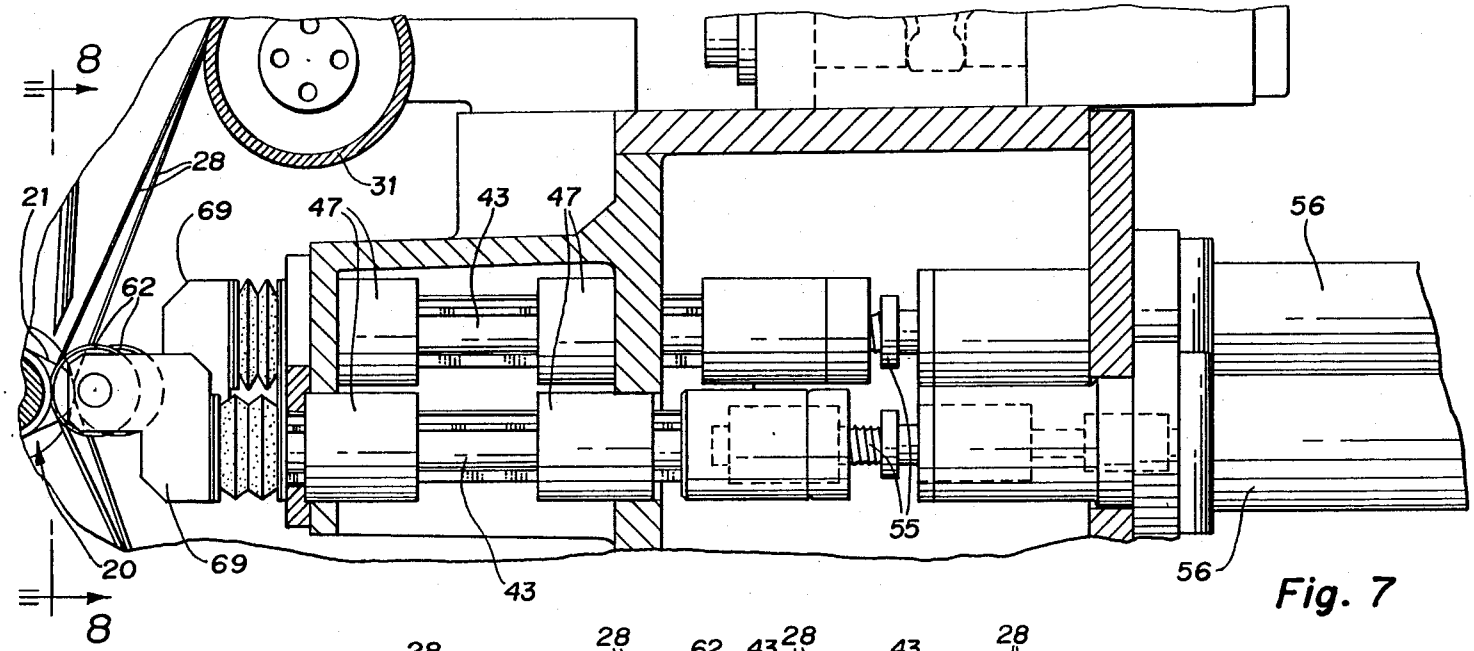
FIG 7 is a fragmentary cross-sectional view from the plane of line 7—7 of FIG. 6 showing the actuators of the contouring means.
Figure 8:
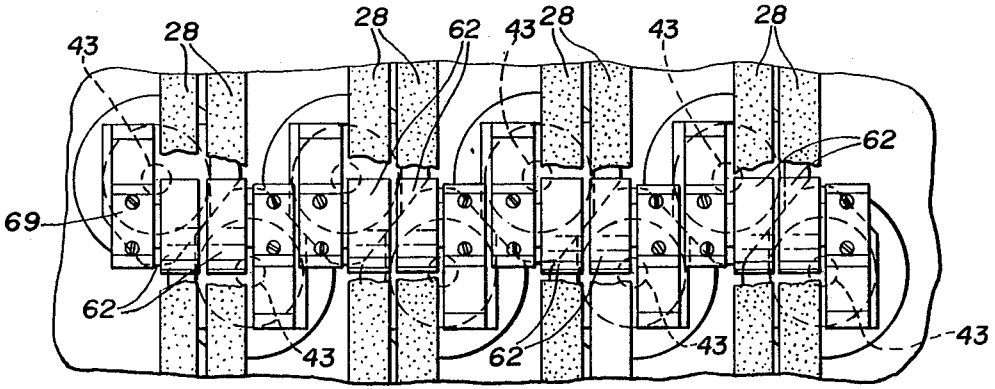
FIG. 8 is a transverse cross-sectional view from the plane of line 8—8 of FIG. 7 and showing the staggered relationship of the actuators and their belt engaging rollers.

In FIGS. 4 and 5 are illustrated two further embodiments of camshaft grinders 57, 58 respectively, having generally the forms previously described and for which like numerals identify like parts. Both embodiments use dual grinding belts 28 supported in a manner such that one of the belts is adjustable relative to the other to vary the spacing between the belts to accommodate differing camshaft designs. The concepts could, if desired, be equally well used in grinders having more than two belts.

In FIG. 4, the two grinding belts 28 of grinder 57 are carried by two separate frame portions of the contouring head assembly, a stationary frame 59 fixed to the feed table 12 and a movable frame 60 mounted for lateral motion on the feed table 12. To accommodate the illustrated close spacing of the belts, they are actuated by pushrods 43 through offset carriers 61. These carry belt engaging contouring wheels 62 instead of the shoes of the earlier described embodiments.

The pushrods 43 are actuated by a master cam arrangement similar to the embodiment of FIGS. 1 and 2.

However, two separate cam members, not shown, are used, one driven by a master cam drive motor, not shown, mounted on the stationary frame 59 and the other driven by a second master cam drive motor 63 mounted on the movable frame 60. This second master cam and the associated pushrod and grinding belt are all laterally movable with lateral movement of the frame 60 to vary the belt spacing as desired. This adjustment is accomplished by an adjusting screw 64 driven through a chain drive 66 by suitable manual or motor drive means, not shown.

The arrangement of FIG. 5 is similar to that of FIG. 4 but differs in that the belt spacing is not so close. This allows the use of centered carriers 67 on the pushrods 43 carrying contouring wheels 62. Also, the master cam mechanism is replaced by a numerically controlled drive similar to that used in the FIG. 3 embodiment and using separate contouring motors 56 for directly driving the pushrods 43 through ballscrews, not shown. The adjusted position of the movable belt mechanism is shown by phantom lines but the mechanism for moving the movable frame 60 relative to the stationary frame 59 is not shown.

MASS PRODUCTION MACHINE

FIGS. 6–10 illustrate the differing features of a grinding machine, or grinder 68, intended for mass production of camshafts. The grinder uses eight fixed position grinding belts 28 arranged to grind simultaneously all of the cams on a typical engine camshaft 20. The grinding belts 28 are spaced with the same intervals as the camshaft cams 21 so as to contact and grind all of the cams simultaneously. Staggered pushrods 43 and numerically controlled contouring motors 56 with ballscrews 55 and linear ball bearing sleeves 47 are used as in the arrangement of FIG. 3, however the vertically offset carriers 69 optionally support belt engaging contouring wheels 62 instead of the shoes 35 of FIG. 3.

Figure 9:
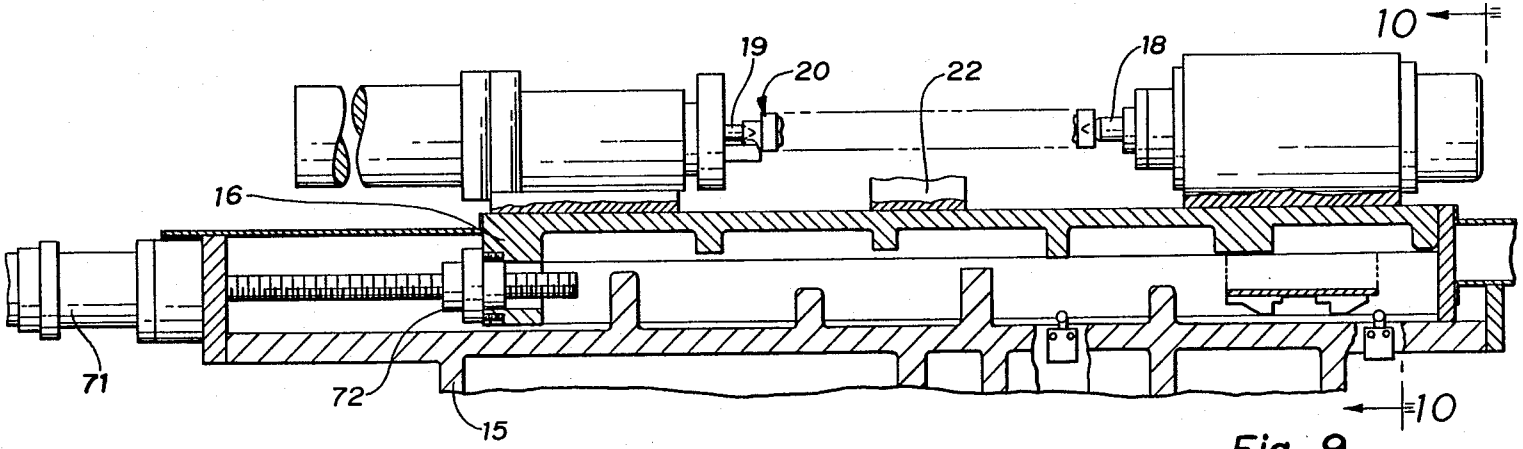
FIG. 9 is a transverse cross-sectional view from the plane of line 9—9 of FIG. 6 through the camshaft workpiece supporting table of a grinding machine and showing a ball screw traversing mechanism for oscillating or indexing the cams.
Figure 10:
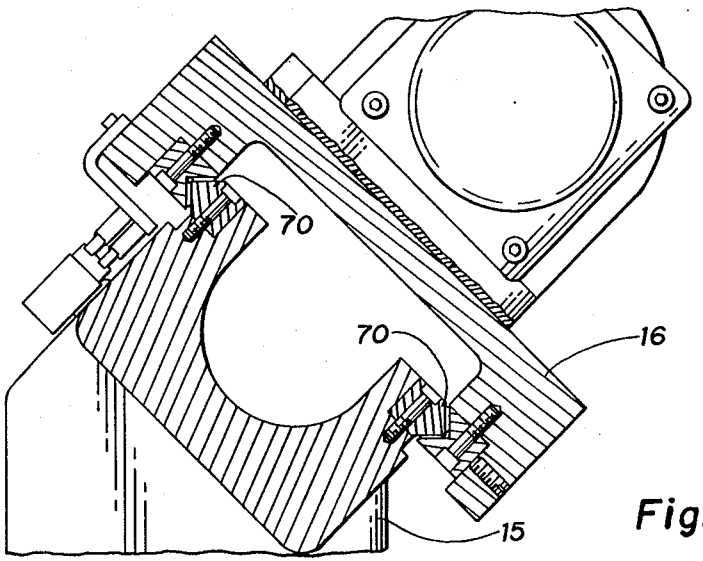
FIG. 10 is a cross-sectional view through the table supporting ways from the plane of the line 10—10 in FIG. 9.

FIGS. 9 and 10 show details of the work table 16 including the ways 70 carried by the support 15 and on which the table 16 is laterally movable. An end mounted drive motor 71 and associated ballscrew 72 are used for oscillation and lateral adjustment of the worktable rather than the back mounted motor 24 of FIG. 1.

LONG WEAR SHOES

Figure 11:
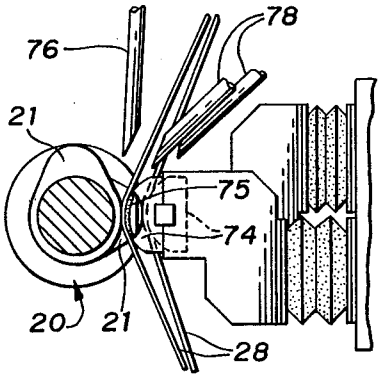
FIG. 11 is side view of an alternative embodiment of contouring means using belt engaging curved shoes with cooling lubricant delivered on both sides of the belt.

FIG. 11 illustrates an alternative arrangement wherein contouring shoes 74 with long wearing inserts 75 are substituted for the contouring wheels 62. The inserts 75 are preferably made of tungsten carbide coated with a long wearing coating, such as silicon nitrider, preferably, a man made polychrystalline diamond, known commercially as Compax diamond, fused to the wearing surface of the insert.

Coolant-lubricant distribution tubes are also provided including outer tubes 76 located to direct cooling liquid onto the cams being ground by the outer sides of the belts 28 and inner tubes 78 located to direct coolant onto the backs of the belts 28. The coolant may be water to which a soluble oil is added, such as is in common use in manufacturing operations. The oil not only protects the workpieces and machine parts from corrosion but also improves the lubricating qualities of the coolant when it is sprayed behind the belts to cool and lubricate the belt travel over the shoes 74. In this way, the wear life of the shoes is greatly extended.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

The embodiments of the invention in which an exclusive property or privilege is claimed are defined as follows:

1. A camshaft belt grinder having a plurality of spaced grinding belts for simultaneously grinding on a camshaft a plurality of longitudinally spaced cams, one with each belt, said grinder comprising means for rotatably supporting a camshaft workpiece having longitudinally spaced cams, means for driving and tensioning said belts in paths aligned with said cams laterally of the camshaft, actuating means operative to engage the belts and individually urge the belts into grinding contact with their respective cams, said actuating means including curved face belt engaging members, one lying adjacent each cam and engaging the opposite side of its belt therefrom, and contouring means connected with each of the belt engaging members and operative to individually advance and withdraw their respective belt engaging members to cause the belts to grind the cam surfaces in desired configurations, and guide means engaging the belts beyond and ahead of their belt engaging members to limit the maximum angle of belt wrap about the curved faces of the belt engaging members, wherein said belt engaging members are stationary contouring shoes, and the curved faces of said shoes have hard wearing surfaces for engaging the belts.

2. A camshaft belt grinder as in claim 1 wherein the hard wearing surfaces include polycrystalline diamond fixed to the curved faces.

3. A camshaft belt grinder as in claim 1 wherein are provided fluid delivery means operative to deliver cooling and lubricating fluid between the belts and the contouring shoes for minimizing wear on the curved faces thereof.

4. A camshaft belt grinder as in claim 1 wherein said plurality of grinding belts is less than the number required to simultaneously grind all the cams on a camshaft workpiece and portions of said belt driving and tensionsing and said contouring means are movable longitudinally of the camshaft to sequentially grind selected groups of the cams.

5. A camshaft belt grinder as in claim 1 wherein the belt driving and tensioning and the actuating means are all carried on a traveling feed table and the camshaft workpiece supporting means carries the camshaft for rotation on a fixed axis.

6. A camshaft belt grinder having a plurality of spaced grinding belts for simultaneously grinding on a camshaft a plurality of longitudinally spaced cams, one with each belt, said grinder comprising means for rotatably supporting a camshaft workpiece having longitudinally spaced cams, means for driving and tensioning said belts in paths aligned with said cams laterally of the camshaft, and actuating means operative to engage the belts and individually urge the belts into grinding contact with their respective cams, said actuating means including curved face belt engaging members, one lying adjacent each cam and engaging the opposite side of its belt therefrom, and contouring means connected with each of the belt engaging members and operative to individually advance and withdraw their respective belt engaging members to cause the belts to grind the cam surfaces in desired configurations, wherein said plurality of grinding belts is less than the number required to simultaneously grind all the cams on a camshaft workpiece and portions of said belt driving and tensioning and said contouring means are movable longitudinally of the camshaft to sequentially grind selected groups of the cams.

7. A camshaft belt grinder having a plurality of spaced grinding belts for simultaneously grinding on a camshaft a plurality of longitudinally spaced cams, one with each belt, said grinder comprising means for rotatably supporting a camshaft workpiece having longitudinally spaced cams, means for driving and tensioning said belts in paths aligned with said cams laterally of the camshaft, and actuating means operative to engage the belts and individually urge the belts into grinding contact with their respective cams, said actuating means including curved face belt engaging members, one lying adjacent each cam and engaging the opposite side of its belt therefrom, and contouring means connected with each of the belt engaging members and operative to individually advance and withdraw their respective belt engaging members to cause the belts to grind the cam surfaces in desired configurations, wherein the belt driving and tensioning and the actuating means are all carried on a traveling feed table and the camshaft workpiece supporting means carries the camshaft for rotation on a fixed axis.

8. A camshaft belt grinder as in claim I wherein the camshaft workpiece supporting means is an axially movable table capable of oscillating the camshaft along its axis.

9. A camshaft belt grinder having a plurality of spaced grinding belts for simultaneously grinding on a camshaft a plurality of longitudinally spaced cams, one with each belt, said grinder comprising means for rotatably supporting a camshaft workpiece having longitudinally spaced cams, means for driving and tensioning said belts in paths aligned with said cams laterally of the camshaft, and actuating means operative to engage the belts and individually urge the belts into grinding contact with their respective cams, said actuating means including belt engaging members, one lying adjacent each cam and engaging the opposite side of its belt therefrom, and contouring means connected with each of the belt engaging members and operative individually advance and withdraw their respective belt engaging members along parallel lines of motion to cause the belt to grind the cam surface in desired configurations, the contouring means of adjacent belt engaging members being offset in generally opposite directions laterally from the lines of motion of their respective belt engaging members to allow closer spacing of the belt engaging members than is permitted of the contouring means.

10. A camshaft belt grinder as in claim 9 wherein said contouring means are driven by power means operative to cause movement of the associated belt engaging members in response to a control input.

11. A camshaft belt grinder as in claim 9 wherein said contouring means are driven by means carrying a pattern cam for each cam of the camshaft and rotatable in synchronized relation to the rotating motion of the camshaft, and follower means having a cam follower for and engaging each of the pattern cams and means connecting each of the cam followers with one of the contouring means for actuating the belt engaging members directly from their associated pattern cams.

12. A camshaft belt grinder as in claim 9 wherein said contouring means of adjacent belt engaging members are alternately disposed above and below the level of the camshaft to be ground to further provide for close spacing of the belt engaging members.

13. A camshaft belt grinder as in claim 12 wherein said contouring means of adjacent belt engaging members are also offset from the line of motion of their respective belt engaging members in generally opposite directions longitudinally of the camshaft workpiece.

14. A camshaft belt grinder as in claim 9 wherein said plurality of grinding belts is less than the number required to simultaneously grind all the cams on a camshaft workpiece and portions of said belt driving and tensioning and said contouring means are movable longitudinally of the camshaft to sequentially grind selected groups of the cams.

15. A camshaft belt grinder as in claim 9 wherein said belt engaging member is a wheel.

16. A camshaft belt grinder as in claim 9 wherein said belt engaging member is a curved shoe having a belt contacting surface made from a low wear material.

17. A camshaft belt grinder as in claim 16 wherein said low wear material includes polycrystalline diamond.

18. A camshaft belt grinder as in claim 9 wherein the belt driving and tensioning and the actuating means are all carried on a traveling feed table and the camshaft workpiece supporting means carries the camshaft for rotation on a fixed axis.

19. A camshaft belt grinding as in claim 18 wherein the camshaft workpiece supporting means is an axially movable table capable of oscillating the camshaft along its axis.

* * * * *